US010793351B2

(12) United States Patent
Watje et al.

(10) Patent No.: US 10,793,351 B2
(45) Date of Patent: Oct. 6, 2020

(54) LEAF COLLECTION VEHICLE

(71) Applicant: Curbtender, Inc., Cedar Falls, IA (US)

(72) Inventors: Kevin Watje, Waterloo, IA (US); Clayton Wright, Waterloo, IA (US); Bartt Weichers, Ackley, IA (US)

(73) Assignee: Curbtender, Inc., Waterloo, IA (US)

( * ) Notice: Subject to any disclaimer, the term of this patent is extended or adjusted under 35 U.S.C. 154(b) by 0 days.

(21) Appl. No.: 16/230,279

(22) Filed: Dec. 21, 2018

(65) Prior Publication Data

US 2020/0198889 A1 Jun. 25, 2020

(51) Int. Cl.

| | |
|---|---|
| ***B65F 3/00*** | (2006.01) |
| ***B65F 3/20*** | (2006.01) |
| ***B65F 3/14*** | (2006.01) |
| *B65F 3/04* | (2006.01) |

(52) U.S. Cl.

CPC ..... *B65F 3/205* (2013.01); *B65F 3/143* (2013.01); *B65F 3/041* (2013.01); *B65F 2003/006* (2013.01)

(58) Field of Classification Search

CPC ..... B65F 3/205; B65F 3/143; B65F 3/041; B65F 2003/006; A01G 20/47; E01H 1/0827

See application file for complete search history.

(56) References Cited

U.S. PATENT DOCUMENTS

| | | | | |
|---|---|---|---|---|
| 2,803,847 | A * | 8/1957 | Hobbs | A01D 51/00 15/314 |
| 3,431,583 | A * | 3/1969 | Daneman | 1/827 |
| 3,556,327 | A * | 1/1971 | Garrison | A01D 85/004 56/344 |
| 3,665,545 | A * | 5/1972 | Beekman | B65F 3/0209 15/314 |
| 4,006,511 | A * | 2/1977 | Larsen | E01H 1/0845 15/422.2 |
| 4,331,542 | A | 5/1982 | Emrie | |
| 4,660,248 | A * | 4/1987 | Young | E01H 1/0863 15/340.1 |
| 4,720,360 | A | 1/1988 | Melber | |
| 4,863,644 | A | 9/1989 | Harrington et al. | |
| 5,181,294 | A * | 1/1993 | Campbell | B08B 15/002 15/315 |

(Continued)

*Primary Examiner* — Kaitlin S Joerger
(74) *Attorney, Agent, or Firm* — McKee, Voorhees & Sease, PLC

(57) ABSTRACT

A leaf collection vehicle utilizing a vehicle body from a refuse collection vehicle having a receiving hopper, a storage compartment, a tailgate assembly, an operator cab and a packer mechanism for transferring refuse from the receiving hopper to the storage compartment, the refuse collection vehicle body being transformed into a leaf collection vehicle by removably installing a fan assembly within the receiving hopper, the fan assembly providing suction for gathering leaves, a suction hose removably attachable to the fan assembly for collecting and transferring leaves initially to the storage compartment and then to the receiving hopper, and a boom member for holding the suction hose, the boom member being operable from the cab compartment of the vehicle and being movable from a storage position along a side of the vehicle body to an operative position for gathering leaves.

12 Claims, 4 Drawing Sheets

(56) References Cited

U.S. PATENT DOCUMENTS 5,218,737 A * 6/1993 Dansby ..... E01H 1/047 15/340.1
5,240,609 A 8/1993 Langley
5,264,126 A 11/1993 Shurtleff
5,317,783 A * 6/1994 Williamson ..... E01H 1/0827 15/346
5,330,688 A 7/1994 Downs
5,545,358 A 8/1996 Hallsten et al.
5,630,247 A * 5/1997 Venia ..... A01G 20/47 15/347
5,718,017 A * 2/1998 Pavlick ..... B65F 3/0209 15/340.1
5,779,890 A 7/1998 Bailey
5,830,356 A 11/1998 Kauppila
5,972,220 A 10/1999 Bailey
5,996,171 A * 12/1999 Bowers ..... B01D 46/002 15/340.1
6,029,312 A * 2/2000 Whitney ..... A01G 20/43 15/347
6,068,134 A 5/2000 Shurtleff
6,090,284 A 7/2000 Melber et al.
6,223,387 B1 * 5/2001 Anderson ..... A01G 20/47 15/340.1
6,274,044 B1 8/2001 Bailey et al.
6,435,802 B1 8/2002 Schreiber et al.
6,454,104 B1 9/2002 Bailey et al.
6,569,328 B1 5/2003 Haggard
6,588,053 B1 * 7/2003 Nowak ..... B60P 1/60 15/340.1
6,655,894 B2 12/2003 Boivin
6,691,413 B2 2/2004 Haggard
6,712,970 B1 3/2004 Trivedi
6,743,362 B1 6/2004 Porteous et al.
6,790,368 B1 9/2004 Vachon et al.
6,821,074 B2 11/2004 Schreiber et al.
6,854,949 B2 2/2005 Huang
7,130,381 B2 10/2006 Lovoi et al.
7,147,777 B1 12/2006 Porteous
7,169,306 B1 1/2007 Porteous et al.
7,172,699 B1 2/2007 Trivedi et al.
7,323,022 B1 * 1/2008 Redlin ..... A01D 43/077 15/340.1
8,060,978 B2 * 11/2011 Young ..... E01H 1/0827 15/340.1
2004/0003481 A1 * 1/2004 Tarrant ..... A01G 20/47 15/340.1
2004/0134021 A1 * 7/2004 Charky ..... E01H 1/047 15/340.2
2004/0177470 A1 * 9/2004 Tarrant ..... A01G 20/47 15/340.1
2007/0095754 A1 5/2007 Livingston et al.
2013/0243555 A1 9/2013 Boivin et al.
2013/0284010 A1 10/2013 Allard et al.

* cited by examiner

LEAF COLLECTION VEHICLE

BACKGROUND OF THE INVENTION

The present invention relates generally to a refuse collection vehicle body and, more particularly, to a refuse collection vehicle body which can be easily converted and transformed into a leaf collection vehicle during that portion of the year where leaf collection is necessary and, wherein the leaf collection vehicle can again be easily converted back to a refuse collection vehicle.

Various types of refuse collection vehicles are well known in the industry. Such refuse collection vehicles typically include a refuse collection vehicle body positioned on the vehicle chassis where the vehicle chassis includes a cab operator compartment for housing the vehicle operator, a frame structure for holding the refuse collection vehicle body including an appropriate number of wheels for carrying the designed load, an engine for powering the vehicle, and various hydraulic and/or pneumatic systems associated therewith.

The refuse collection vehicle body typically includes a receiving hopper, a storage compartment and a mechanism for emptying the refuse material collected within the storage compartment. The receiving hopper is typically located forward of the storage compartment and is designed to receive the refuse material when loaded within the vehicle body. A wall or partition member typically separates the receiving hopper from the storage compartment. The storage compartment typically includes a body design for holding the refuse material and a rear access door for allowing egress of the stored refuse or waste material. The partition or wall member separating the receiving hopper from the storage compartment typically includes a passageway for allowing the refuse material from the receiving hopper to be transferred to the storage compartment.

Transfer of the refuse material from the receiving hopper to the storage compartment can be accomplished in several different ways. One mechanism includes a longitudinal sliding packer device which moves the refuse from a front portion of the receiving hopper through the opening associated with the divider wall member into the storage compartment. Another mechanism typically used is a pendulum style packer mechanism where the packing device is pivotally mounted within the receiving hopper and swings in the arcuate fashion from a raised position to a position adjacent the opening in the divider wall so as to again transfer the refuse material from the receiving hopper through the divider wall opening into the storage compartment. These packer devices are typically operated through the use of hydraulic cylinders.

A pivotally mounted tailgate associated with the rear portion of the storage compartment allows the operator to move the tailgate to an open position to permit transfer of the stored refuse material from the storage compartment to a landfill site or other location.

During the fall season, road side or curb side leaf collection is necessary. Specially designed leaf collection vehicles have limited use since they can only be utilized during the leaf collection season. In addition, to dedicate a specific vehicle to leaf collection only is not only expensive, but it also increases the maintenance and storage requirements for a refuse collection fleet operator.

One known leaf and light debris collection vehicle is a vehicle made by Labrie. This vehicle does not include a receiving hopper and the fan assembly is permanently mounted between the cab and vehicle body so the fan assembly cannot be removed. The location of the Labrie fan assembly causes the overall length of the vehicle to be extended several feet. This creates adverse effects to the vehicle in overall performance and turning radius. Since there is no receiving hopper, this vehicle transfers leaves only into a storage compartment. A compaction system is incorporated into the storage compartment but compaction cannot take place simultaneously with the collection of leaves. These functions must take place separately.

It is therefore desirable to develop a leaf collection vehicle which can be easily converted or transformed from a typical standard refuse collection vehicle when leaf collection is necessary and, importantly, in which the leaf collection vehicle can again be transformed back into a refuse collection vehicle when the leaf collection season is over. It is also desirable to provide a leaf collection vehicle which allows an operator to perform the leaf collection task without leaving the operator cab, and wherein leaf compaction can occur in the receiving hopper through the already existing hydraulically movable packer device associated with a typical refuse collection vehicle.

SUMMARY OF THE INVENTION

A typical refuse collection vehicle includes a refuse collection vehicle body having a receiving hopper, a storage compartment, a packer device mounted within the receiving hopper for transferring the refuse material from the receiving hopper to the storage compartment in a conventional manner, and a pivotally mounted tailgate assembly associated with the rear portion of the storage compartment. The receiving hopper is separated from the storage compartment by a wall or partition divider member which includes a passageway for allowing the refuse material to be transferred from the receiving hopper to the storage compartment.

According to one aspect of the present invention, a fan assembly can be mounted within the receiving hopper and a leaf collection boom can be attached to the fan assembly for vacuuming leaves from a leaf collection area. The leaf collection boom includes a suction hose and the boom and hose can be folded back to the side of the vehicle body for storage and transportation when not in use. The receiving hopper can be enclosed so that leaves can be collected therein and thereafter compacted using the packer mechanism associated with the refuse collection vehicle. The fan assembly is powered by the vehicle engine and is hydraulically driven through the hydraulic system already present on a refuse collection vehicle. A joystick inside the cab compartment controls the boom movement and is specifically designed for allowing the operator to conduct leaf collection from inside the cab compartment. The compaction and ejection functions of the leaf collection vehicle are likewise powered by the hydraulic system associated with the refuse collection vehicle.

The present leaf collection vehicle collects leaves both in the storage compartment and in the receiving hopper. Leaves are initially stored in the storage compartment and when the storage compartment is full, leaves are then stored in the receiving hopper. Leaves in the receiving hopper are compacted using the packer device and the compacted leaves are then transferred to the storage compartment. Compaction of the leaves in the receiving hopper and collection of the leaves into either the receiving hopper or the storage compartment can take place simultaneously.

Importantly, once the leaf collection season has concluded, the leaf collection boom and suction hose can be easily and quickly removed from the refuse collection vehicle body, the fan assembly can likewise be easily and quickly removed from the receiving hopper, and cart dumpers can be easily re-installed on one or both sides of the receiving hopper so that the vehicle body can be returned to its original use as a refuse collection vehicle. Installation of the leaf collection assembly and removal of such assembly can each be accomplished in a single work day. This conversion assembly allows a fleet operator to easily convert a refuse collection vehicle to a leaf collection vehicle when necessary and provides the fleet operator with more flexibility, less vehicle maintenance, and less storage capacity by not purchasing and storing single use leaf collection vehicles.

These and other specific aspects and advantages of the present invention will be apparent to those skilled in the art after reviewing the following detailed description of illustrated embodiments set forth below which, taken in conjunction with the accompanying drawings, disclose an easily convertible leaf collection vehicle.

BRIEF DESCRIPTION OF THE DRAWINGS

For a better understanding of the present invention, reference may be made to the following accompanying drawings.

While the present disclosure is susceptible to various modifications and alternative forms, a specific embodiment of the present invention is shown by way of example in the present drawings and will hereinafter be described in detail. It should be understood, however, that the present drawings and detailed description presented herein are not intended to limit the disclosure to the particular embodiment disclosed, but to the contrary, the intention is to cover all modifications, equivalents, and alternatives falling within the spirit and scope of the present disclosure as defined by the appended claims.

DETAILED DESCRIPTION OF THE INVENTION

Figure 1:
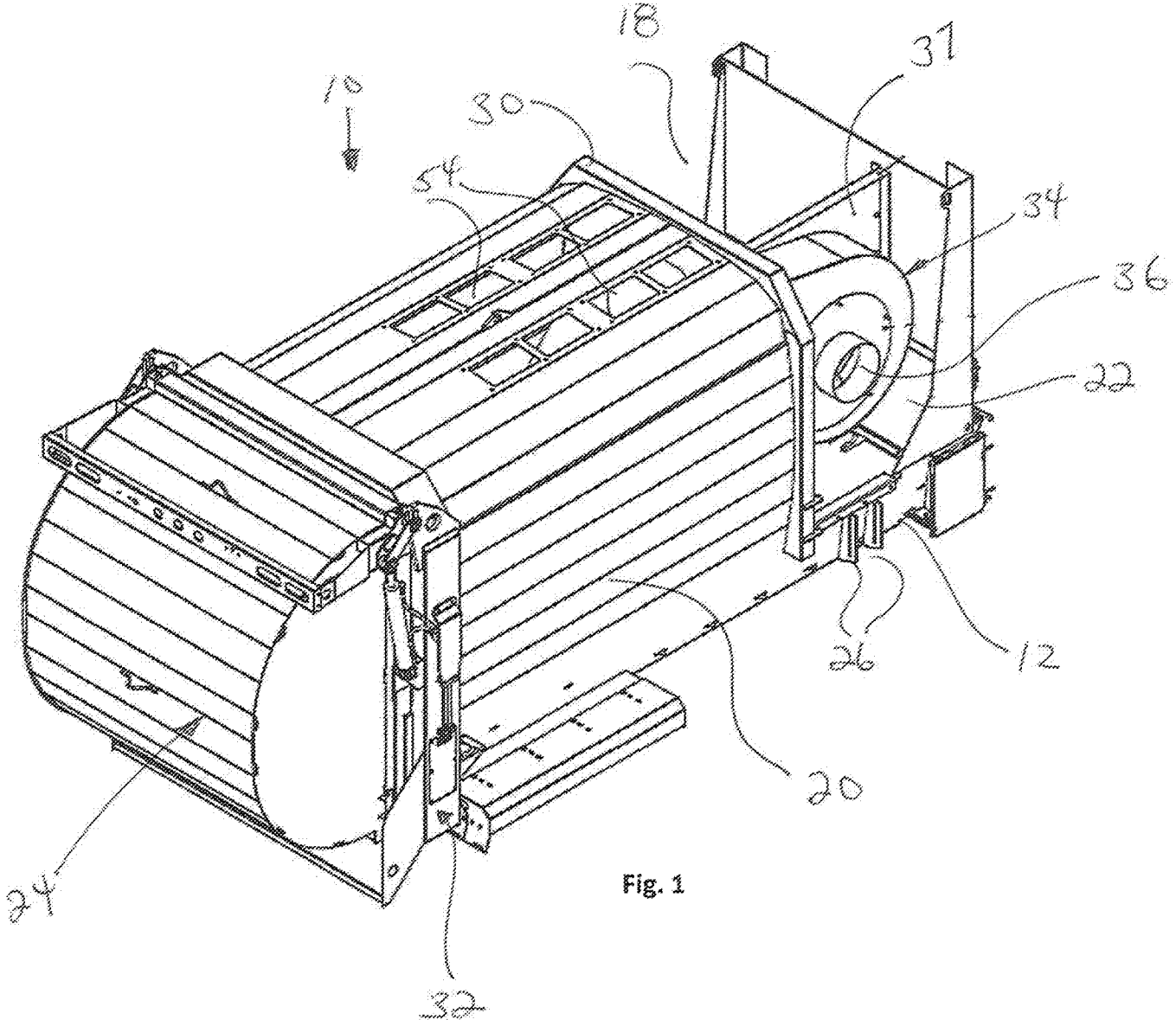
FIG. 1 is a perspective view of a typical refuse collection vehicle body showing the fan assembly of the present invention attached thereto in accordance with the teachings of the present invention.

Referring to the drawings more particularly by reference 10 wherein like numerals refer to like parts, numeral 10 in FIG. 1 illustrates a typical refuse collection vehicle body incorporating the present leaf collection fan assembly 34 of the present invention. The refuse collection vehicle body 10 includes a chassis frame structure 12, an appropriate number of front and rear sets of wheels 14 (FIG. 3) for carrying the design load of the vehicle, a cab or operator compartment 16 (FIG. 3) for housing the vehicle operator and other appropriate control panels for operating the various systems associated with the present vehicle, and an engine (not shown) for powering the vehicle and the hydraulic and/or pneumatic systems associated therewith. The refuse collection vehicle body 10 is mounted on top of the chassis frame structure 12 in a conventional manner as illustrated in FIG. 1.

According to one aspect of the present invention, the refuse collection vehicle body 10 includes a receiving hopper 18 for initially receiving refuse material, a storage compartment 20, a packer device 22 mounted within the receiving hopper 18 for transferring the refuse material from the receiving hopper to the storage compartment 20 in a conventional manner, and a pivotally mounted tailgate assembly 24 associated with the rear portion of the storage compartment 20 for both containing the refuse material within the storage compartment when the tailgate assembly 24 is in its closed position and for allowing egress of the refuse material stored within the storage compartment 20 when the tailgate assembly is in its open position.

The receiving hopper 18 typically includes an open top portion through which refuse material may be deposited by an automated container loading mechanism. The brackets 26 illustrated in FIG. 1 are utilized for holding the automated container loading mechanism associated with a typical refuse collection vehicle. Container loading mechanisms are well known in the art and typically include an arm member for grasping and holding a trash container. When activated, the container loading mechanism will lift a trash container and pivot the same for dumping into the open top portion of the receiving hopper 18. The container holding mechanism may be hydraulically or pneumatically operated and may include appropriate hydraulic cylinders or pneumatic activating cylinders for lifting, dumping and returning a trash container to its curb side position.

The receiving hopper 18 may also include one or more side openings (not shown) associated with the side wall structure 42 and 44 (FIG. 3) of the receiving hopper 18 for allowing manual loading of refuse material into the receiving hopper. The receiving hopper 18 may also include a selectively movable lid or cover member such as cover member 28 illustrated in FIG. 3 for opening and closing access to the receiving hopper 18. The movable lid or cover member 28 may be manually movable between an open and closed position, or it can be movable through the use of hydraulic or pneumatic actuators.

Figure 2:
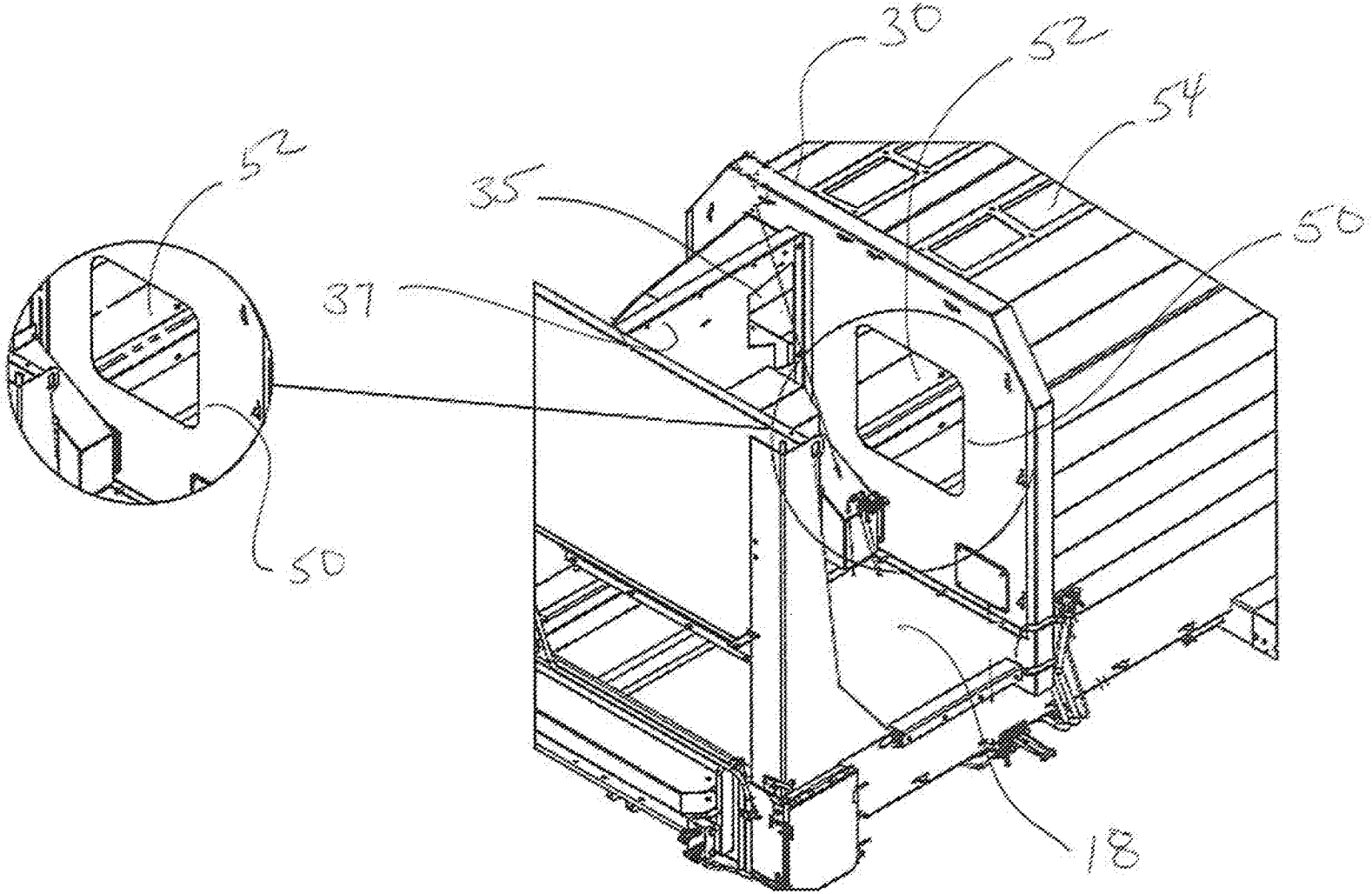
FIG. 2 is a partial perspective view showing the interior portion of the refuse collection receiving hopper.

A divider wall 30 as best illustrated in FIGS. 1 and 2 typically divides the receiving hopper 18 from the storage compartment 20. Divider wall 30 likewise typically includes an opening (not shown) located adjacent its bottom portion for providing access from the receiving hopper 18 to the storage compartment 20. The packer device 22 operates in a conventional manner and is typically hydraulically controlled for both compressing the refuse material stored within the receiving hopper 18 and moving such refuse material from the receiving hopper 18 into the storage compartment 20. The packing device 22 typically includes a head portion which will engage the refuse material deposited within the receiving hopper 18 and moves such material through the opening located in the divider wall member 30 into the storage compartment 20. It is recognized that the divider wall 30 may be a separate member formed between the receiving hopper 18 and the storage compartment 20, or divider member 30 may be associated with one end portion of the receiving hopper 18 or with one end portion of the storage compartment 20.

As best illustrated in FIG. 1, the tailgate assembly 24 is pivotally mounted to the tailgate frame structure 32 in a conventional manner through the use of one or more hydraulic cylinders. This pivotal connection can be accomplished through the use of flange members associated with the frame structure 32 in a conventional manner.

The present invention is specifically directed to converting a typical refuse collection vehicle to a leaf collection vehicle by simply removably attaching a fan assembly 34 to the divider wall member 30, or to other structure associated with the receiving hopper 18, as best illustrated in FIG. 1. The fan assembly 34 is attached over an opening (not shown) in the divider wall 30, this fan opening being above the movement of the packer device 22 and above the opening in the divider wall 30 through which the packer device 22 moves refuse into the storage compartment 20. This arrangement prevents the fan assembly from interfering with the packer device movement when compressing leaves in the receiving hopper 18. In this regard, the receiving hopper 18 is utilized to receive and compact leaves collected by the leaf collection vehicle once the storage compartment 20 is filled as will be hereinafter further explained. The fan assembly 34 may include wall structure 37 as best illustrated in FIGS. 1 and 2. Mounting the fan assembly 34 in the receiving hopper 18 allows for the collection of leaves both in the storage compartment and in the receiving hopper as will be further explained. Also, the fan assembly 34 is constructed so as to be removably attached to structure in the receiving hopper 18 so that it can be easily removed as will be also further explained. The fan assembly 34 is not permanently attached to the receiving hopper 18.

The fan assembly 34 is powered by the vehicle engine and the fan motor is hydraulically driven by the hydraulic system associated with the refuse collection vehicle as will be hereinafter further explained. The fan bearings are lubricated and cooled with hydraulic oil associated with the refuse collection vehicle. The fan assembly 34 includes a connection opening 36 which is sized and dimensioned to receive one end portion 38 of the vacuum/suction hose 40 illustrated in FIG. 3. To this end, side plate members 42 and 44 are attached to the opposite side portions of the receiving hopper 18 and side plate member 42 is specifically designed so as to include an opening 46 for providing access to the fan connection opening 36 as again illustrated in FIG. 3. Side plate member 44 is typically associated with the receiving hopper 18 associated with a typical refuse collection vehicle and may be in the form of a door which can be opened and closed at will depending upon the particular application.

Figure 3:
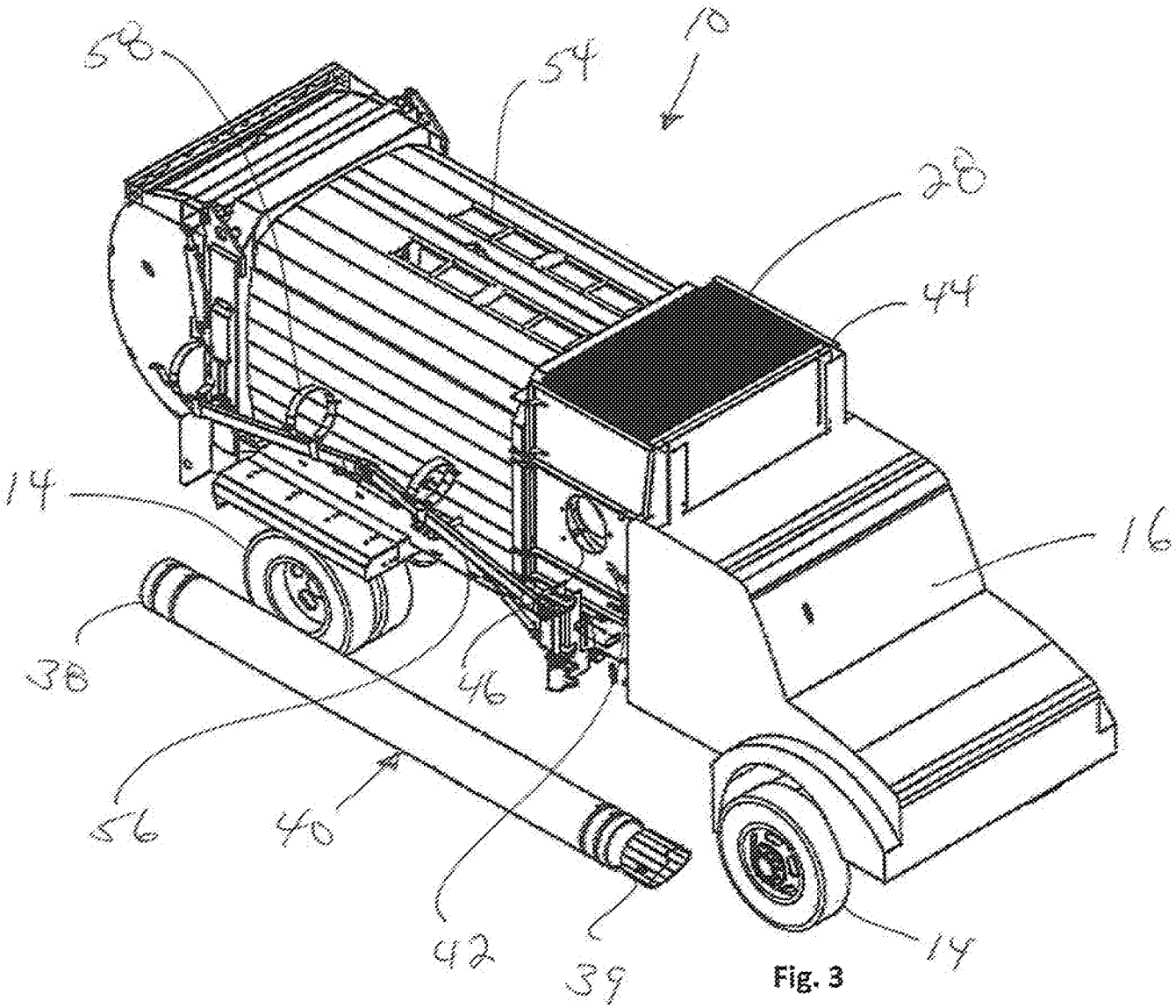
FIG. 3 is a perspective view of a typical refuse collection vehicle showing the leaf collection assembly of the present invention associated therewith, the leaf collection suction hose being shown in exploded form.

If additional openings such as opening 50 illustrated in FIG. 2 exists within the divider wall member 30 or other side wall members associated with the receiving hopper 18, all such additional openings can be typically closed using either a screen member such as screen member 52 or a suitable plate member. The same is likewise true with any openings 54 associated with storage compartment 20 as best illustrated in FIGS. 2 and 3. All such openings are covered with either a screen material or a suitable plate member so as to contain the leaves received within the storage compartment 20.

A leaf collection boom member 56 as best illustrated in FIG. 3 is attached to the container loader mechanism brackets 26 (FIG. 1) and the boom member 56 is attached to separate hydraulic actuators which are installed when the boom member 56 is installed. The hydraulic mechanism used to lift, clamp and return trash containers to curb side is removed during this installation. Attaching the boom member 56 to the cart tipper mounting plate or brackets 26 allow for easy attachment and detachment of the boom member 56 to the vehicle. The boom member 56 is not attached to the fan assembly or to any other additional structure added to the refuse collection vehicle. The leaf collection boom 56 is hydraulically movable from its folded side storage position as illustrated in FIG. 3 to an operative position for vacuuming leaves from a street or curb side location. The leaf collection boom 56 includes a plurality of cradles or clamps 58 for holding the vacuum/suction tube 40 in proper position on the leaf collection boom 50. When the vacuum/suction tube 40 is removably attached to the fan opening 36 and cradled within the boom clamps 58 of boom member 56, the boom member 56 can be hydraulically operated through the use of a joystick 60 located within the operator cab 16.

Figure 4:
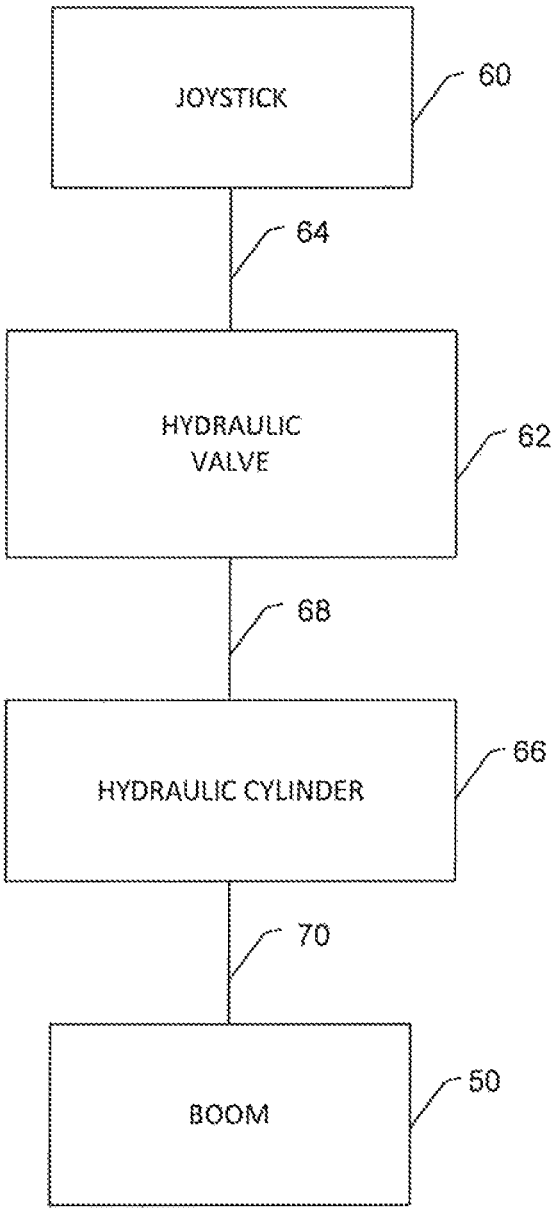
FIG. 4 is a simplified schematic diagram showing the operation of the leaf collection boom through the use of a joystick located in the operator cab.

FIG. 4 is a simple schematic diagram showing the operation of the boom member 56 through the use of joystick 60 located within the operator cab 16. In this regard, joystick 60 is operatively connected to a hydraulic valve 62 through the use of a wire harness 64 and the hydraulic valve is operatively connected to one or more hydraulic cylinders 66 and their respective actuators via hydraulic lines 68. One or more hydraulic cylinders 66 are operatively connected to the leaf collection boom member 56 via connecting pins or other appropriate hardware 70. The hydraulic valve 62 can be located in any convenient location on the refuse collection body, preferably close to the brackets 26. When the vehicle operator wants to manipulate the leaf collection boom 56, the operator engages joystick 60 and moves the joystick 60 from within the cab so as to direct the movement of the boom member 56 in any one or more of at least four different directions including left, right, up and down based upon movement of joystick 60. The joystick 60 sends appropriate signals via wire harness 64 to the hydraulic valve 62 which in turn controls movement of the one or more hydraulic cylinders 66 which are operatively connected to boom member 56. As a result, the vehicle operator can move the boom member 56 and the cradled vacuum/suction hose 40 from its side storage position as illustrated in FIG. 3 to a position wherein the opposite end portion 39 of the vacuum/suction hose 40 is positioned adjacent a curb side, street side or other location within the reach of hose member 40 so as to vacuum suck leaves through hose member 40 into the storage compartment 20 as will be hereinafter further explained. The fan assembly 34 provides the vacuum or sucking power to transfer leaves through hose member 40 into the storage compartment 20. All of the hydraulic and/or pneumatic systems associated with a typical refuse collection vehicle are utilized to operate the present leaf collection system. No change in the systems is necessary when converting the refuse collection vehicle to a leaf collection vehicle.

In operation, leaves are sucked through the hose member 40 via fan assembly 34 and such vacuumed leaves are transferred through the fan assembly itself and through the opening over which the fan assembly 34 is mounted for transfer into the storage compartment 20. Once the storage compartment 20 is filled with leaves, the opening over which the fan assembly 34 is mounted is blocked with leaves thereby allowing the fan assembly 34 to further collect and transfer leaves through an additional opening 35 located on the side of the fan assembly 34 as best illustrated in FIG. 2, the opening 35 allowing additional leaves to be collected and stored within the receiving hopper 18. As leaves are now collected within the receiving hopper 18, the packer device 22 can now be utilized to compress and compact the leaves within the receiving hopper as they are being transferred through the opening located in the divider wall member 30 for accomplishing such transfer. As the packer device compacts the leaves and moves such compacted leaves into the storage compartment, the leaves already present in the storage compartment are likewise compressed as the compacted leaves are moved into the storage compartment space. Compaction of the leaves in the receiving hopper 18 after the storage compartment is full of unpacked leaves allows for more leaves to be stored within the storage compartment 20. Also, importantly, compaction of the leaves in the receiving hopper 18 can take place simultaneously with the collection of leaves by the suction hose 40. Vacuuming of the leaves can occur at the same time that the packer device 22 compacts leaves in the receiving hopper.

It is recognized that the receiving hopper 18 must be enclosed for receiving leaves within such compartment. If the receiving hopper 18 does not include a lid or cover member, then a cover member such as cover member 28 is positioned over the top of receiving hopper 18 so as to fully enclose such hopper for the collection of leaves therewithin. As leaves are collected within the receiving hopper, the packer device 22 is utilized to compress and compact the leaves within the receiving hopper as they are being transferred to the storage compartment. Compaction of the leaves in the receiving hopper 18 allows for more leaves to be stored within the storage compartment 20. The PTO driven hydraulic system associated with a typical refuse collection vehicle is utilized to power the leaf collection assembly as well as the compaction and ejection functions.

Once the leaf collection season is over, the leaf collection vehicle as described above with respect to FIGS. 1-4 can easily be re-converted to a refuse collection vehicle by simply removably detaching the vacuum/suction tube 40 from the boom member 56; by removably detaching the boom member 56 from the flange members 26; by removably detaching side member 42 and fan assembly 34 from within the receiving hopper 18, and thereafter reconnecting the container loader mechanism to flange members 26, reattaching the appropriate hydraulic lines, and re-structuring the side walls, divider member and cover member associated with receiving hopper 18 compatible for refuse collection.

Converting an existing refuse collection vehicle into a leaf collection vehicle for the leaf collection season is highly advantageous to refuse collection operators in that they no longer have to dedicate a specific vehicle to leaf collection year round. Instead, they can easily convert one or more of their existing refuse collection vehicles into a leaf collection vehicle during the leaf collection season and thereafter re-convert the leaf collection vehicle into a refuse collection vehicle for refuse collection year round. This not only saves time and storage space, it is likewise economical in that a specifically devoted leaf collection vehicle does not sit idle for a good portion of the year when leaf collection is not necessary.

Compaction of the leaves allows the present leaf collection vehicle to collect and store more leaves than a conventional leaf collection vehicle and operation of the leaf collection boom by a single operator from within the vehicle operator cab likewise reduces the man power necessary for collecting leaves. The present leaf collection assembly is designed for one operator collection and it ensures the safety of the operator since the operator remains inside the operator cab at all times. In addition, since leaves are compacted and compressed within the receiving hopper 18, this provides additional room for manual collection of bags of green waste which can be thrown inside the receiving hopper by sliding or opening the cover member 28, or by opening and closing side door member 44. Hydraulic compaction of the leaves allows for larger loads of leaves to be stored within the storage compartment 20 of the present vehicle.

Although a specific refuse collection vehicle body 10 has been identified and discussed herein, it is recognized and anticipated that many of the components and systems associated with the present leaf collection system can be fashioned into a variety of different sizes and shapes other than those illustrated herein and that other components associated with the various systems and assemblies may likewise be correspondingly shaped to conform to the chassis structure of any particular refuse collection vehicle without departing from the teachings and practice of the present invention.

It is also recognized that the overall dimensions of the various components associated with the present leaf collection vehicle as well as the specific shape and configuration of the various members associated therewith such as the divider wall member 30, fan assembly 34, the vacuum/suction hose 40, the leaf collection boom 56, the side panels 42 and 44 and the cover member 28 are also subject to wide variations and may be sized and shaped into a wide variety of different sizes and configurations so as to be compatible with the size and shape of the overall refuse collection vehicle body 10, or to conform with any other space limitations associated therewith without impairing the teachings and practice of the present invention. Other variations and modifications to the various components comprising the present leaf collection vehicle are likewise envisioned and contemplated.

Thus, there has been shown and described a leaf collection vehicle which can be easily transformed from a refuse collection vehicle body. As is evident from the foregoing description, certain aspects of the present invention are not limited by the particular details and the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not "as required". Many changes, modifications, variations and other uses and applications of the present invention, will, however, become apparent to those skilled in the art after considering the present specification and the accompanying drawings. All such changes, modifications, variations and other uses and applications, which do not depart from the spirit and scope of the present invention, are deemed to be covered by the invention which is limited only by the claims which follow.

The invention claimed is:

1. A leaf collection vehicle comprising:

a vehicle body having a receiving hopper for receiving leaves, a storage compartment for receiving leaves, a tailgate mechanism for accessing the storage compartment, and an operator cab compartment;

a frame structure for holding the vehicle body;

a divider wall separating the receiving hopper from the storage compartment, the divider wall having at least one opening for allowing leaves from the receiving hopper to be transferred to the storage compartment;

a fan assembly removably attachable within the receiving hopper, the fan assembly providing suction for collecting leaves within both the storage compartment and the receiving hopper;

a suction hose having one end portion thereof removably attachable to the fan assembly for collecting and transferring leaves initially to the receiving hopper and then to the storage compartment; and a boom member for cradling the suction hose, the boom member being movable from a storage position located adjacent a side portion of the vehicle body to an operative position angularly related thereto for allowing the suction hose to collect leaves for transfer to the receiving hopper.

2. The leaf collection vehicle of claim 1 including a packer device located in the receiving hopper for compacting the leaves collected therein and for transferring the compacted leaves to the storage compartment.

3. The leaf collection vehicle of claim 2 wherein the compacting of the leaves in the receiving hopper can occur simultaneously with the collection of the leaves by the suction hose.

4. The leaf collection vehicle of claim 1 including enclosing the receiving hopper with wall members.

5. The leaf collection vehicle of claim 1 wherein the vehicle body and divider wall include openings, at least some of said openings being covered with screen members attachable over said openings for preventing leaves from exiting through said openings.

6. The leaf collection vehicle of claim 1 wherein the vehicle body and divider wall includes openings, at least some of said openings being covered with plate members attachable over said openings for preventing leaves from exiting therethrough.

7. The leaf collection vehicle of claim 1 including a control unit located in the cab compartment for controlling movement of the boom member between its storage position and an operative position angularly related thereto.

8. The leaf collection vehicle of claim 7 wherein said boom member is hydraulically operated through the control unit.

9. A leaf collection vehicle comprising:

a vehicle body having a receiving hopper for receiving leaves, a storage compartment for receiving leaves, a tailgate mechanism for accessing the storage compartment, and an operator cab compartment;

a frame structure for holding the vehicle body;

a divider wall member separating the receiving hopper from the storage compartment, the divider wall having at least one opening therein for allowing leaves from the receiving hopper to be transferred to the storage compartment;

a fan assembly removably attachable at a location within the receiving hopper, the fan assembly providing suction for gathering leaves;

a suction tube having one end portion thereof removably attachable to the fan assembly for collecting and transferring leaves initially to the receiving hopper and when the receiving hopper is full, then to the storage compartment;

a boom member for cradling the suction hose, the boom member being hydraulically operated from a control unit in the vehicle cab compartment, the boom member being movable from a side storage position to an operative position angularly related thereto; and a packer device located in the receiving hopper for compacting the leaves collected therein and for transferring the compacted leaves to the storage compartment, the compaction of leaves in the receiving hopper occurring simultaneously with the collection of leaves by the suction hose.

10. The leaf collection vehicle of claim 9 wherein the receiving hopper is closed with wall members and a cover member.

11. In a refuse collection vehicle having a vehicle body, a receiving hopper, a storage compartment, a divider wall between the receiving hopper and the storage compartment having an opening associated therewith, a tailgate assembly, an operator cab, a packer mechanism for transferring refuse from the receiving hopper to the storage compartment, a vehicle engine, and a vehicle hydraulic system, the improvement comprising:

removably attaching a fan assembly at a location within the receiving hopper, the fan assembly being operatively connected to the vehicle engine and vehicle hydraulic system;

closing the receiving hopper with side wall members and a cover member;

a suction hose having one end portion thereof removably attached to the fan assembly for collecting and transferring leaves initially to the receiving hopper and when the receiving hopper is full, then to the storage compartment; and a boom member for cradling the suction hose, the boom member being operatively connected to the vehicle hydraulic system for movement thereof.

12. The improvement of claim 11 wherein the packer device compacts the leaves stored in the receiving hopper and transfers the leaves from the receiving hopper to the storage compartment.

* * * * *